US005790007A

United States Patent [19]

Yasukuni

[11] Patent Number: 5,790,007

[45] Date of Patent: Aug. 4, 1998

[54] BOARD FUSE, AND METHOD OF MANUFACTURING THE BOARD FUSE

[75] Inventor: Jun Yasukuni, Yokkaichi, Japan

[73] Assignee: Sumitomo Wiring Systems, Ltd., Yokkaichi, Japan

[21] Appl. No.: 619,800

[22] Filed: Mar. 20, 1996

[30] Foreign Application Priority Data

Mar. 23, 1995 [JP] Japan ..... 7-091698
Mar. 23, 1995 [JP] Japan ..... 7-091699

[51] Int. Cl.[6] ..... H01H 85/04

[52] U.S. Cl. ..... 337/166; 337/142; 337/161; 337/166; 337/227; 337/293; 337/415; 29/623

[58] Field of Search ..... 337/160–190, 337/201, 227, 273, 293, 295, 290, 414–417, 142; 29/623

[56] References Cited

U.S. PATENT DOCUMENTS 4,037,318 7/1977 Burkley et al. ..... 29/623
4,149,137 4/1979 Konnemann ..... 337/295

FOREIGN PATENT DOCUMENTS 368 033 2/1923 Germany .
368 034 2/1923 Germany .
1130 054 5/1962 Germany .
3530 354 3/1987 Germany .
8801878 4/1988 Germany .
52-86148 7/1977 Japan .
56-38959 4/1981 Japan .
61-14625 4/1986 Japan .
456 749 5/1968 Switzerland .

*Primary Examiner*—Leo P. Picard
*Assistant Examiner*—Jayprakash N. Gandhi
*Attorney, Agent, or Firm*—Oliff & Berridge, P.L.C.

[57] ABSTRACT

A board fuse includes an insulating board having a through-hole window in the middle of the insulating board and fusible elements laid over the insulating board. Further, the fusible elements are continuous metal wires substantially equal in cross section. The fusible elements are uniform and accurate in cross section and accurate in current capacity. The fusible elements extend across the window in such a manner that, at the window, they are not in contact with the insulating board. Hence, when heat is generated in any one of the fusible elements by electric current, the heat generated at the window is not absorbed by the insulating board and is increased as required, thus blowing the fusible element accurately. Accordingly, the board fuse is free from the difficulties caused by the heat generation, that is, the production of a bad smell, at worst the production of white smoke.

22 Claims, 6 Drawing Sheets

BOARD FUSE, AND METHOD OF MANUFACTURING THE BOARD FUSE

BACKGROUND OF THE INVENTION

1. Field of the Invention

This invention relates to a board fuse, and a method of manufacturing the board fuse, and more particularly to a board fuse which has electrically conductive fusible elements having a predetermined current capacity which are laid over an insulating board, and a method of manufacturing the board fuse.

2. Description of the Related Art

A board fuse of this type has been disclosed by Japanese Utility Patent Application (OPI) No. 38959/1981 (the term "OPI" as used herein means an "unexamined publication application"). As shown in FIGS. 9 and 10, the board fuse comprises an insulating board (or insulating bearer) 1, a pair of terminals 2 and 2 formed on the surface of the insulating plate material by etching, and a fuse link 3 small in width which is connected between those terminals 2 and 2.

When a current larger than a predetermined value flows between the terminals 2 and 2 formed on the insulating board, the current generates heat in the fuse link 3 smaller in width than the terminals 2, thus melting off the fuse line 3. The predetermined current value which blows the fuse link (hereinafter referred to as "current capacity", when applicable) depends on the thickness and width of the fuse link 3.

The above-described conventional board fuse suffers from several problems. First, the current capacity depends on the cross sectional area of the elongated fuse link. Hence, to accurately blow a board fuse small in current capacity, the cross sectional area of the fuse link must be made to have high dimensional accuracy. However, to do so by etching is difficult. In another method, the narrow portion of the fuse link is formed by cutting a metal plate on a press. However, the method is disadvantageous in that the cross sectional area of the fuse link is readily varied when the latter is rolled on the press, which makes it difficult to ensure that the fuse links to have a predetermined current value with high accuracy.

Second, when heat is generated in the fusible element 2, the heat thus generated is partially absorbed by the insulating board 1, so that the fusible element 2 is not blow with its predetermined current capacity. Third, the heat blowing the fusible element 2 scorches the insulating board 1, thus giving off a bad small, at worse producing white smoke.

SUMMARY OF THE INVENTION

In view of the foregoing, an object of the invention is to provide a board fuse which is free from the difficulties discussed above, and a method for manufacturing the board fuse.

The foregoing object of the invention has been achieved by providing a board fuse comprising an insulating board and fusible elements having a predetermined current capacity which are laid on a surface of the insulating board. According to the invention, the fusible elements are continuous metal wires substantially equal in cross sectional area. In one embodiment of the invention, the continuous metal wires are each in the form of a piece of flat tape. In another embodiment of the invention, the continuous metal wires are each circular in cross section. Further, the insulating bearer has grooves in which the metal wires are fixedly laid.

Also, the insulating board has a recess in the surface thereof, and the fusible elements are laid across the recesses in such a manner that, at the recess, the fusible elements are out of contact with the insulating board. The recess is a window-like hole formed in the insulating board. The insulating board is folded in two in such a manner that the window-like hole is on the folding line.

The board fuse further comprises a cap which is placed over the window of the insulating board after it is folded.

The invention also provides a method of manufacturing a board fuse in which a recess is formed in a surface of an insulating board. Fusible elements that are continuous metal wires that are substantially equal in cross-section to one another, having a predetermined current capacity are laid over the surface of the insulating board such that the fusible elements extend across the recess out of contact with the insulating bearer. The fusible elements are fixedly bonded to the surface of the insulating bearer.

By constructing the continuous metal wires each in the form of a piece of flat tape, the metal wires can be arranged and stably held on the surface of the insulating bearer with ease.

Further, continuous metal wires that are each circular in cross section are readily available. Hence, a variety of metal wires can be employed as the fusible elements.

Also, by providing the insulating bearer with grooves in which the metal wires are fixedly laid, the metal wires can be accurately set on the insulating bearer by utilizing the grooves and kept therein at all times.

As was described above, in the board fuse of the invention, the recess is formed in a middle part of the insulating board, and the fusible elements are laid over the insulating board such that, at the recess, they are not in contact with the insulating board or anything. Hence, when heat is generated in the fusible element by current, the heat in the portions of the fusible element which are in contact with the insulating board is absorbed by the latter, but the heat in the middle portion of the fusible element which is located at the recess is not, thus blowing the fusible element with high accuracy. Since the middle portion of the fusible element is not in contact with the insulating board, the insulating board, is not scorched by the heat. Thus, bad smells and white smoke are avoided.

If the recess formed in the insulating board is a bottomed one, then the fusible elements laid over the insulating board may be in contact with the bottom so that the heat generated in the fusible elements may be absorbed thereby. However, where the recess is a through-hole window formed in the insulating board, the fusible elements are in contact with nothing. Thus, the board fuse is free from the difficulty that the heat generated in the fusible element is absorbed unintentionally, thus adversely affecting the current capacity of the latter (the fusible element being blown inaccurately).

Further, since the insulating board is folded in two such that the window is on the folding line, the middle portions of the fusible elements are held curved. Both end portions of each of the fusible elements are on the front and rear surfaces of the insulating board, respectively, so they can be electrically connected to external elements at one end of the insulating board thus folded. For example, in a mating part of the board fuse with which the board fuse is engaged, metal terminals can be set to hold (or clamp) the folded insulating board. This feature contributes to economical use of the available limited space.

Additionally, the curved portions of the fusible elements are covered with the cap so that they are prevented from being damaged by foreign matter. Accordingly, the board fuse of the invention is high in operability, and can be readily handled.

In the method of manufacturing the board fuse, the recess is formed in the surface of an insulating board, and the fusible elements having a predetermined current capacity are laid over the surface of the insulating board such that the fusible elements extend across the recess, and at the recess the fusible elements are not in contact with the insulating board. Hence, the heat in the portion of each of the fusible elements which are located at the recess is less absorbed than in the remaining portions. Thus, the fusible elements are blown with high accuracy.

DETAILED DESCRIPTION OF PREFERRED EMBODIMENTS

Figure 1:
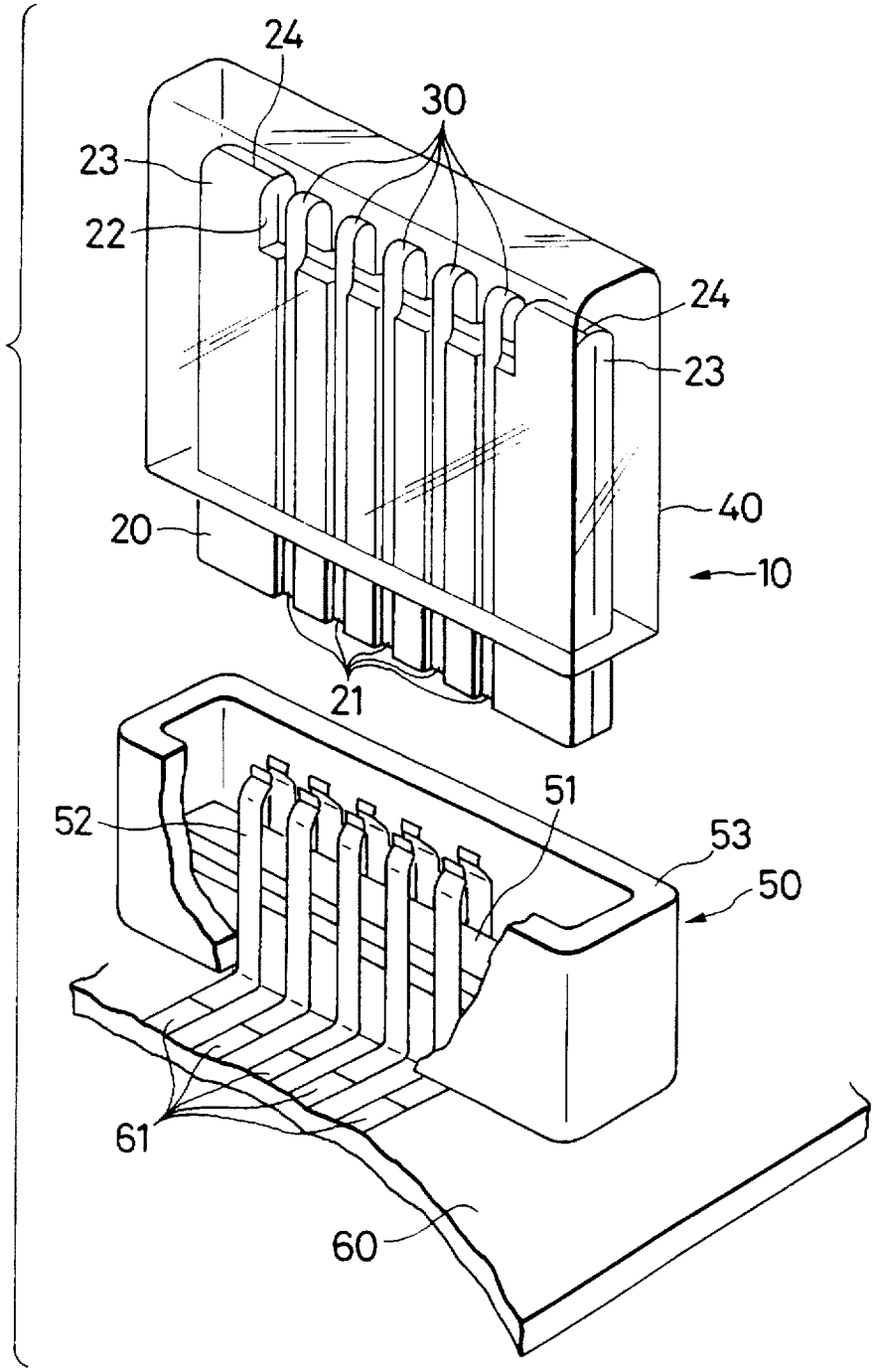
FIG. 1 is an exploded perspective view showing a board fuse according to a first embodiment of the invention, and a socket with which the board fuse is to be engaged.

While the invention will hereinafter be described in connection with preferred embodiments thereof, it will be understood that it is not intended to limit the invention to those embodiments. On the contrary, it is intended to cover all alternatives, modifications, and equivalents that may be included within the spirit and scope of the invention as defined by the appended claims.

For a general understanding of the features of the invention, reference is made to the drawings. In the drawings, like reference numerals have been used throughout to designate identical elements.

Figure 2:
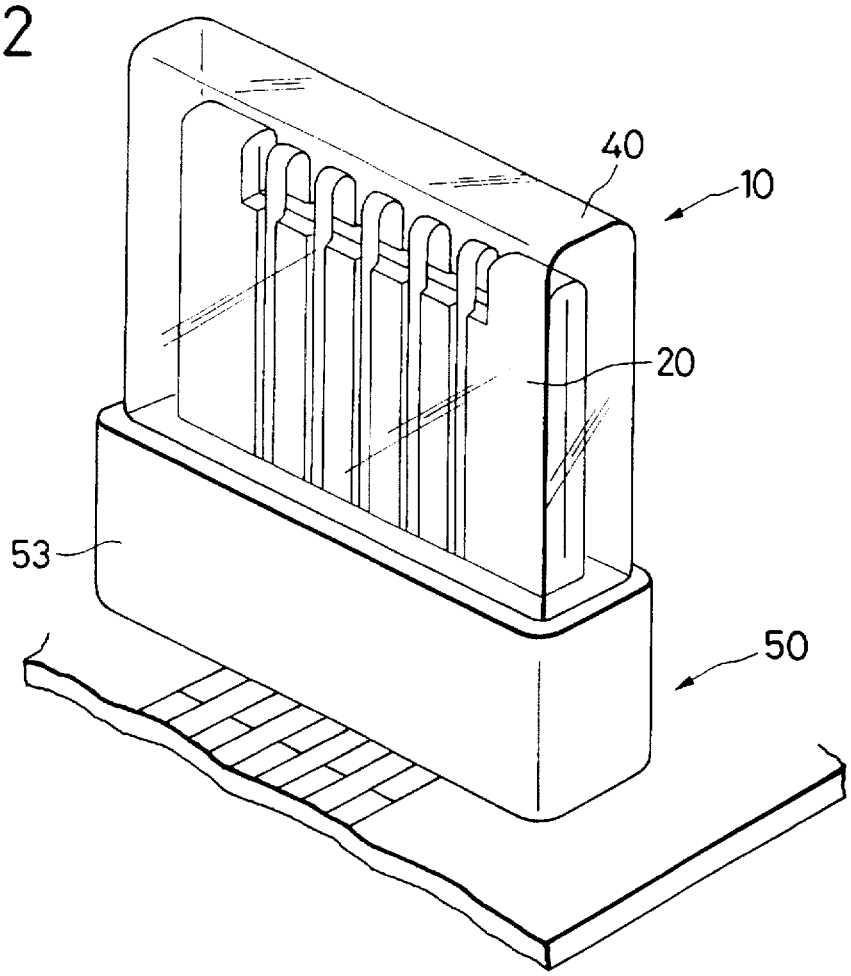
FIG. 2 is a perspective view of the board fuse engaged with the socket shown in FIG. 1.

FIGS. 1 and 2 are perspective views showing a board fuse according to a first embodiment of the invention, and a socket with which the board fuse is engaged. More specifically, FIG. 1 shows the board fuse which is going to be engaged with the socket, and FIG. 2 shows the board fuse which has been engaged with the socket.

As shown in FIGS. 1 and 2, the board fuse 10 comprises an insulating board (or insulating bearer) 20, five flat-tape-shaped fusible elements 30 arranged on the surface of the insulating board 20, and a cap 40 which covers the fusible elements 30. The socket 50 comprises a plate-shaped base material 51, five pairs of terminal electrodes 52 arranged on both sides of the base material 51 and a hood-shaped housing 53 which covers the terminal electrodes 52. The housing 53 has an upper opening, into which the lower end portion of the board fuse 10 is inserted.

Figure 3:
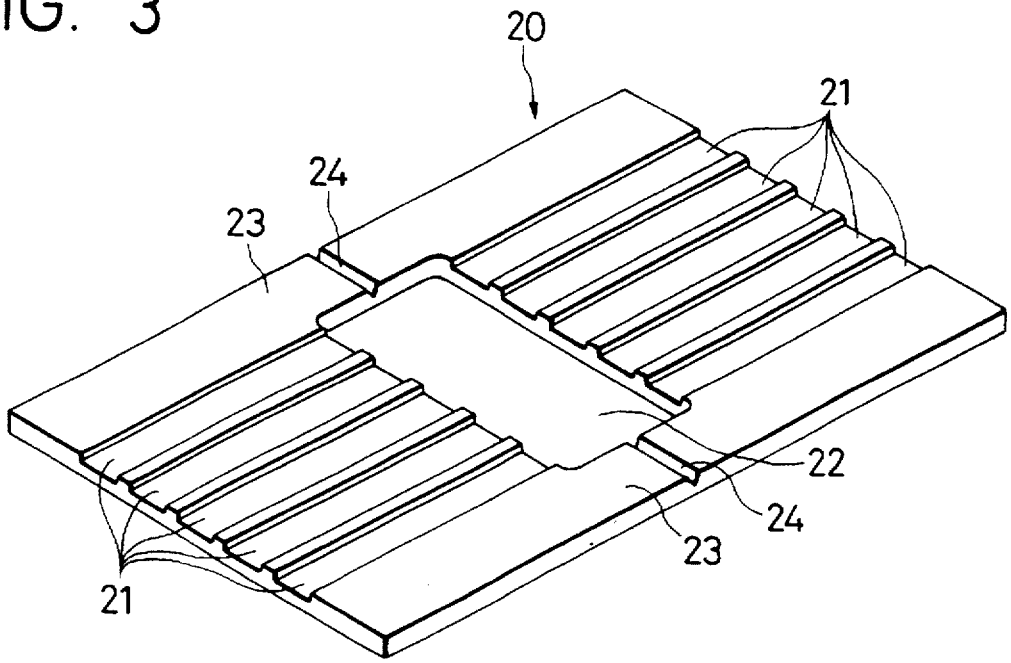
FIG. 3 is a perspective view of an insulating board in the board fuse.

The insulating board 20 of the board fuse 10 is a rectangular plate of resin as shown in FIG. 3. The rectangular plate has five longitudinally extending grooves 21 in its surface and a rectangular window 22 which is opened across the five grooves 21, that is, the window 20 divides each of the five grooves 21 into two parts. The insulating board 20 has two hinge portions 23, one on each side of the window 20. The hinge portions 23 each have a thin groove 24 along which the insulating board 20 is folded in two.

The window, which cuts each of the grooves 21 into two parts, functions as a recess as shown in FIGS. 1 and 2. The recess is formed such that the fusible elements 30 laid over the surface of insulating board 20 are not in contact with the insulating board 20 within the area of the recess. It is not necessary that the window be in the form of a through-hole, for instance, it may be a bottomed hole. As shown, one recess is formed for the five grooves 21. However, five recesses may be formed for each of the five grooves 21, respectively. The grooves 21 are guide grooves for arranging the fusible elements 30, respectively. They serve to maintain the fusible elements 30 in position and/or prevent them from interference with external materials. Accordingly, the grooves 21 may be each rectangular or circular in section according to the cross-sectional configuration of the fusible elements 30 employed. However, the invention is not limited thereto or thereby.

Figure 4:
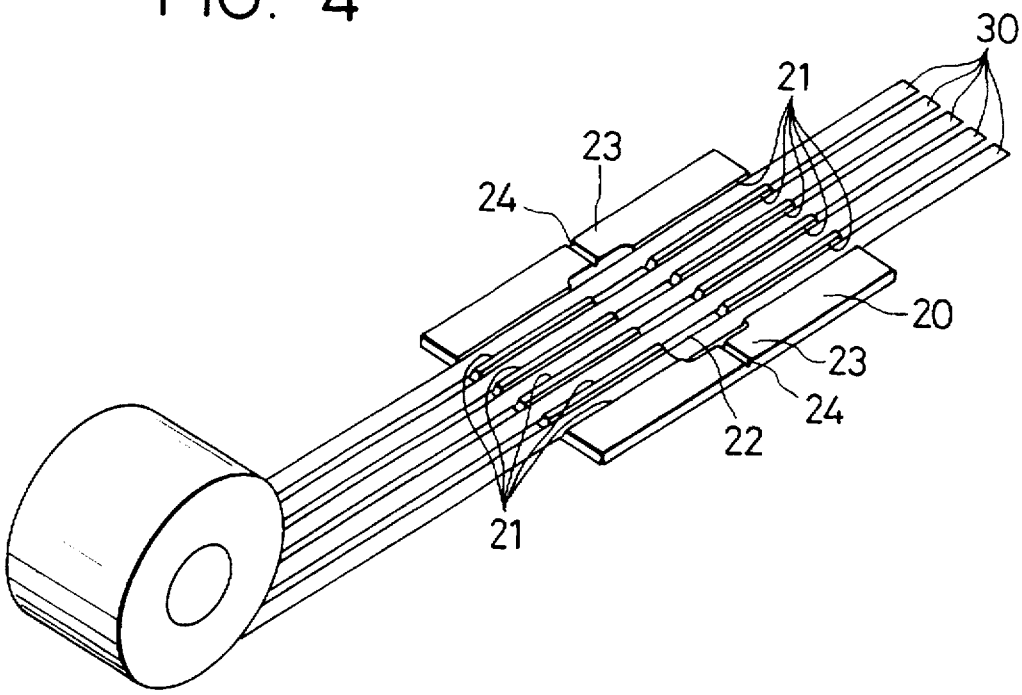
FIG. 4 is a perspective view of the arrangement of fusible elements over the insulating board.

As shown in FIG. 4, a roll-shaped fusible-element supplier is provided which is formed by winding five metal flat-tape-shaped fusible elements 30 on a core in such a manner that they are in parallel with one another. The five fusible elements unrolled from the supplier are laid in the above-described five grooves 21, respectively, across the window 22. The fusible elements thus laid are then each cut along both ends of the insulating board, that is, along both ends of each of the grooves 21. To fixedly mount the fusible elements 30 in the grooves 21, the rear surfaces of the flat-tape-shaped fusible elements 30 may be applied with paste in advance, or the grooves 21 may be applied with paste in advance. In the former method, the paste remains in the middle portions of the fusible elements which are laid like bridges over the window (hereinafter referred to as "bridging portions", when applicable). In the latter method, no paste is found in the bridging portions.

In the above-described embodiment, the fusible element 30 is in the form of a piece of flat tape. However, the pieces of flat tape may be replaced with continuous metal wires which are substantially uniform in cross-sectional area and accordingly substantially constant in current capacity. Thus, the fusible element 30 may be circular in cross section, or semi-circular so that it is stably fixed on the surface of the insulating board 20. It is advantageous that the fusible element 30 has a flat surface so that it is stably seated on the insulating board 20. On the other hand, though, it is also advantageous to employ the fusible element 30 circular in cross section, because such a structure has a wide range of application and in the case of fusible elements circular in cross section, many kinds of fusible elements different in dimension are available. It is preferable that the fusible element is of a metal having a relatively low melting point.

In the above-described embodiment, the five fusible elements 30 are supplied from one roll-shaped fusible-element supplier which has five rolled fusible elements wound thereon. However, the five fusible elements 30 may be supplied from five roll-shaped fusible element suppliers, respectively, each of which is formed by winding a piece of tape-shaped fusible element 30 thereon. Alternatively, the five fusible elements 30 may be laid by using (by moving back and forth over the insulating board) only one roll-shaped fusible element supplier of the latter type.

Also, the fusible elements may be laid by using a roll which is formed as follows. A plurality of continuous metal wires are bonded onto a piece of tape which is minimally stretched, and then the piece of tape together with the metal wires is rolled to form the source roll. This method is advantageous in that in laying the fusible elements, the wires are prevented from being stretched, and can be readily laid in parallel to each other.

Figure 5:
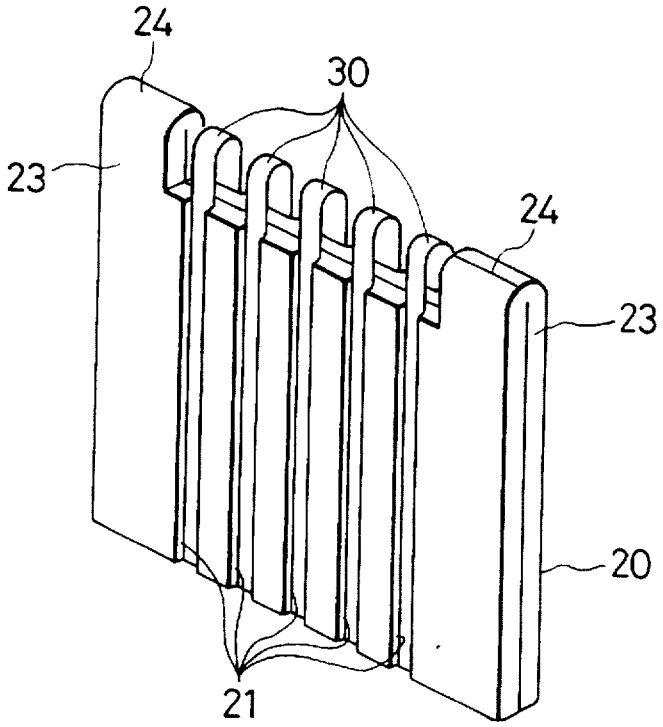
FIG. 5 is a perspective view showing the insulating board which is folded in half together with the fusible elements.

After the fusible elements 30 have been laid, as shown in FIG. 5 the insulating board 20 is folded in half along the hinges 23 formed on each side of the window 22. Before the folding operation, the rear surface of the insulating board 20 is applied with paste, so that both end portions of the insulating board 20 are pasted together when the latter 20 is folded in half. The hinges 23 have the folding grooves 24, so that insulating board 20 is folded accurately.

As the insulating board 20 is folded, the bridging portions of the fusible elements 30 which are laid over the window 22 are naturally curved without being tensioned. No tension is applied to the bridging portions of the fusible elements. Hence, the bridging portions are neither affected in cross-sectional area nor accordingly in current capacity. In the above-described embodiment, the rear surface of the insulating board 20 is applied with paste, so that the insulating board 20 is maintained folded. However, the invention is not limited thereto or thereby, that is, an engaging protrusion and an engaging recess may be formed in the insulating board 20 such that the insulating board 20 is held folded through the engagement of the protrusion and the recess.

After the insulating board 20 has been folded, as shown in FIG. 1 it is covered with a transparent hood-shaped cap 40. The length of the cap 40 is selected so that the lower end portion of the insulating board thus folded appears slightly. Since the cap 40 is transparent, the fusible elements 30 held curved can be observed through the cap 40 from the outside. Accordingly, it can be visually detected whether the fusible elements 30 are blown (melted). The inside of the cap 40 is so shaped that its inner surface is brought into close contact with the surfaces of the insulating board 20, but not with the fusible elements 30. That is, as was described before, the fusible element 30 are arranged in the grooves 21, but do not protrude from the latter 21. Hence, the inner surface of the cap 40 is not in contact with the fusible elements 30 in the grooves 21. Therefore, when the insulating board 20 thus folded is capped with the cap 40, the latter 40 is not brought into contact with the fusible elements 30. This feature prevents the fusible elements 30 from being partially rolled (deformed) and changed in cross section. Since the fusible elements 30 are maintained unchanged in cross-section, they are not changed in current capacity.

In the above-described embodiment, the cap 40 is so designed as to cover the side surfaces of the insulating board 20. However, its side-surface-covering length may be changed. Also, in the above-described embodiment, the grooves 21 are formed in the insulating board 20. However, they may be formed in the inner surface of the cap 40. If the fusible elements 30 are high in hardness, then the formation of the grooves may be omitted.

The length of the cap 40 depends on the socket 50. The socket 50 is formed by covering the plate-shaped base material 51 with the hood-shaped housing 53. The lower end portion of the board fuse 10 is inserted into the housing through its upper opening. The end portion of the board fuse 10, which is inserted into the housing 53 of the socket 50, is the portion of the folded insulating board 20 which is not covered with the cap 40. The fusible elements 30 appear on the front and rear surfaces of the lower end portion of the folded insulating board 20, and five pairs of terminal electrodes 52 are held on both surfaces of the base material in such a manner that the terminal electrodes 52 are confronted with each other. The upper end portions of the terminal electrodes 52 are in the form of flexible arms which extend above the base material 51 and push against the fusible elements 30. The lower end portions of the terminal electrodes 52 extend through a gap between the base material 51 and the housing 53 and are bent at right angles. The lower end portions thus bent, and accordingly the terminal electrodes 52, are fixedly soldered to wires 61 formed on a printed circuit board 60.

Figure 6:
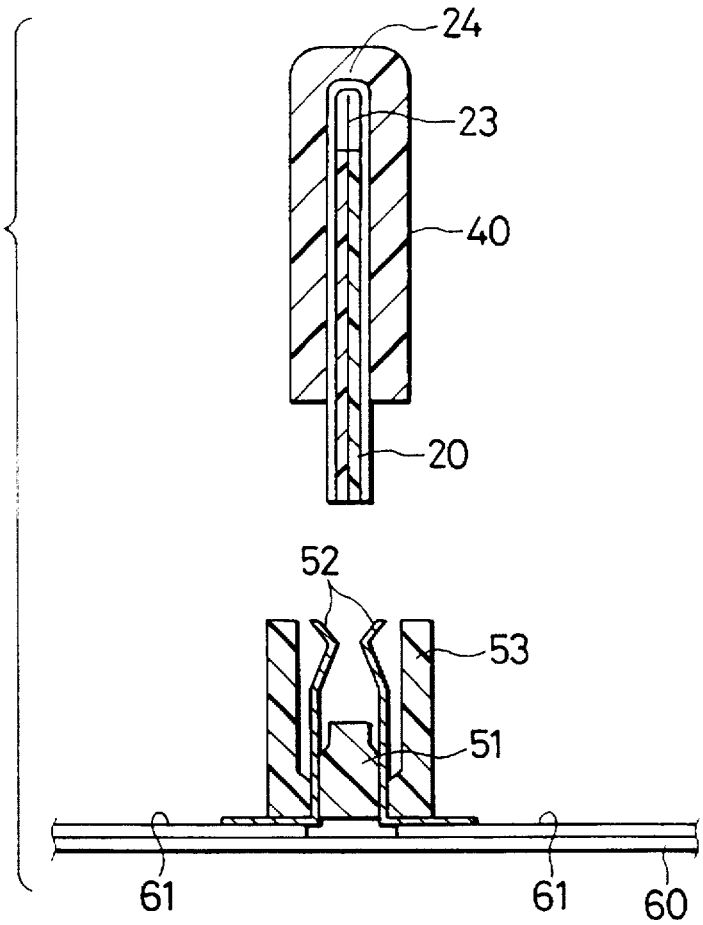
FIG. 6 is a sectional view of the board fuse and the socket which are shown in FIG. 1.

As shown in FIG. 6, the lower end portion of the folded insulating board 20 of board fuse 10 covered with the cap 40 is pushed into the socket 50 from above. As a result, the fusible elements 30 on the front and rear surfaces of the folded insulating board 20 are brought into contact with the terminal electrodes 52, that is, they are electrically connected to the terminal electrodes 52, while the board fuse 10 is fixedly held by the socket 50 as shown in FIG. 2.

In the above-described embodiment, the socket 50 holds the insulating board 20. However, the embodiment may be modified such that the housing 53 is further extended upwardly and increased in opening area, so that the housing 53 holds the lower end portion of the latter 40, to support the latter 40.

With the board fuse 10 engaged with the socket 50, current is applied to each of the fusible elements 30. In operation, each fusible element 30 generates heat. The portions of the fusible element 30 which are in contact with the insulating board 20 do not increase in temperature, because the heat generated therein is substantially absorbed by the insulating board 20. At the window 22 of the insulating board 20, the fusible elements 30, more specifically, the curved (bent) portions of the fusible elements 30, are not in contact with the insulating board 20, and therefore, the curved portion of each of the fusible elements 30 increase in temperature earlier than the remaining portions depending on the current applied thereto. When the current reaches a predetermined value, the curved portion is blown, i.e., melted, by the heat. The fusible elements 30 are of a metal wire substantially uniform in cross-section which are bonded to the insulating board. In the case where current flows in the fusible element 30, the current capacity is determined in proportion to the cross-sectional area. Since the continuous metal wire is uniform in cross sectional area, it blows accurately at all times.

The fusible elements 30 are blown at the window 22 of the insulating board 20. If they are blown on the insulating board 20, then the latter 20 is scorched, smells bad, at worst producing white smoke. However, the embodiment is free from this difficulty, because the bent portions of the fusible elements are blown which are not in contact with the insulating board 20. When any one of the fusible elements 30 is blown, it can be readily visually detected because the cap 40 is transparent.

As was described above, the fusible elements 30 laid over the insulating board 20 are of the same metal wire which is substantially uniform and accurate in cross-sectional area.

Thus, a number of board fuses accurate in current capacity can be formed according to the invention.

Further, in laying the fusible elements 30 over the insulating board 20, the recess, namely, the window 22 is formed in the insulating board 20 in advance, and the fusible elements 30 are laid across the window 22. Hence, in the case when heat is generated in the fusible element 30 by the current applied thereto, the heat in the bridging portion of the fusible element in the window is not absorbed by the insulating board, thus blowing the fusible element with high accuracy.

Figure 8:
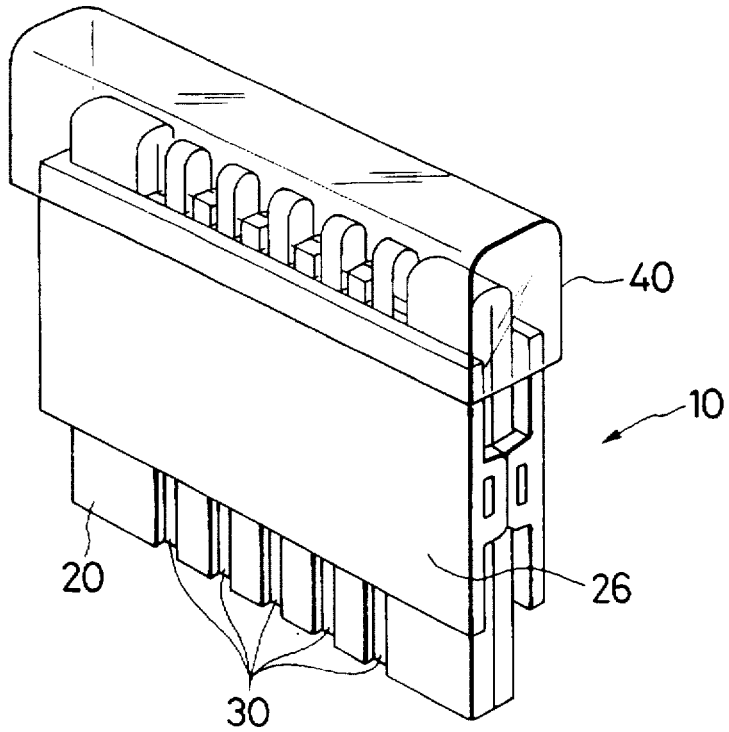
FIG. 8 is a perspective view of the board fuse shown in FIG. 7.
Figure 7:
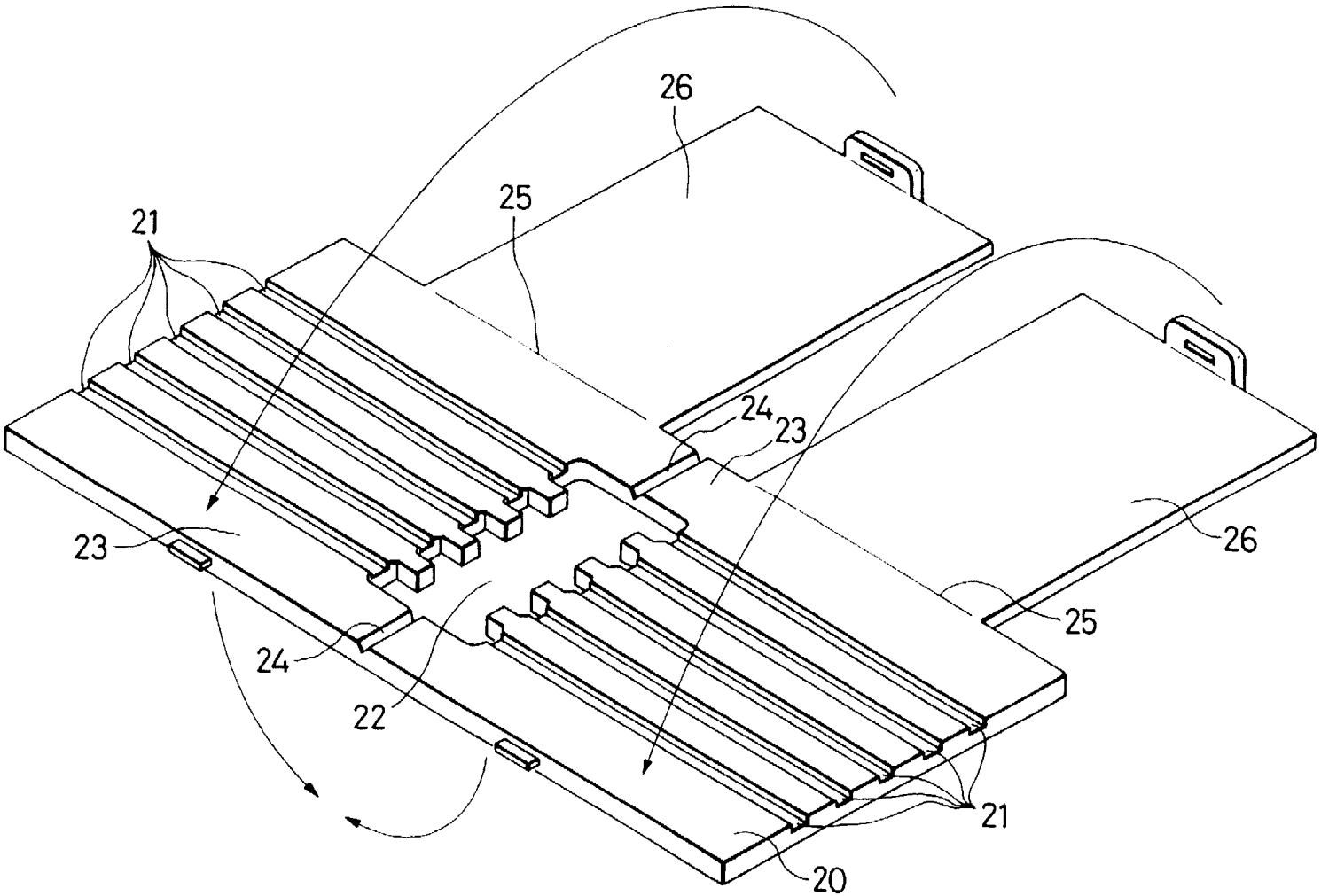
FIG. 7 is a perspective view showing an insulating board of the board fuse according to a second embodiment of the invention.
Figure 9:
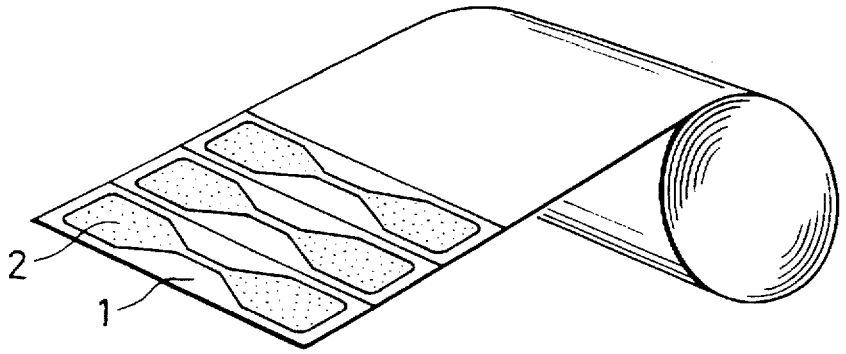
FIG. 9 PRIOR ART
FIG. 9 is a perspective view for a description of a method of manufacturing of the conventional board fuse.
Figure 10:
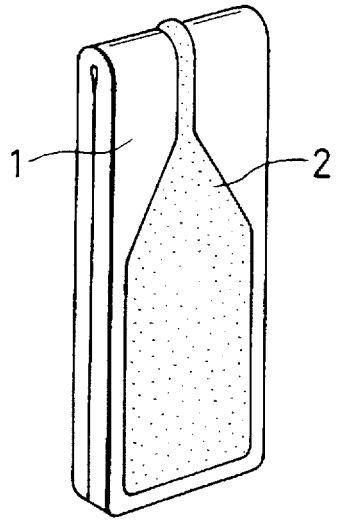
FIG. 10 PRIOR ART
FIG. 10 is a perspective view of the conventional board fuse.

FIGS. 7 and 8 show a second embodiment of the invention. In the second embodiment, the insulating board 20 having the window 22 is also folded in half. However, it should be noted that, for protection of the fusible elements 30, a pair of covers 26 are made integral through a pair of hinges 25 with the two parts (or front and rear parts) of the insulating board 20. That is, after the fusible elements 30 are laid in the grooves 21, the covers 26 are bent along the line 25 over the front and rear parts of the insulating board 20. The covers 26 have locking mechanisms on their outer edges, while the front and rear parts of the insulating board 20 have the mating locking mechanisms on the corresponding edges, so that the covers 26 are fixedly held bent over the front and rear parts of the insulating board 20.

With this arrangement, similarly as in the above-described first embodiment, the insulating board 20 is folded along the hinge 24 so that the front and rear part of the insulating board 2 are in contact with each other, and then the upper end portion of the folded insulating board 20 is covered with a cap 40 shorter than the one in the first embodiment.

While the invention has been described in conjunction with embodiments thereof, it is evident that many alternatives, modifications and variations may be apparent to those skilled in the art. Accordingly, it is intended to embrace all alternatives, modifications, and variations which may fall within the spirit and broad scope of the appended claims.

What is claimed is:

1. A board fuse, comprising:

an insulating bearer; and a plurality of fusible elements having a predetermined current capacity which are laid on a surface of the insulating bearer, wherein the insulating bearer has a through-hole window in the surface thereof and the plurality of fusible elements are continuous metal wires that are laid across the recess to extend from one side of the recess to another side of the recess out of contact with the insulating bearer in an area of the recess.

2. The board fuse of claim 1, wherein the insulating board is capable of being folded in half, the window being on the folding line.

3. The board fuse of claim 1, further comprising a hood-shaped transparent cap fitable over the insulator bearer once folded.

4. The board fuse of claim 1, wherein the insulating bearer further comprises a pair of thin fold grooves on each side of the window and the insulating bearer is folded in half at the pair of thin fold grooves.

5. The board fuse of claim 4, further comprising a hood-shaped transparent cap fitable over the insulator bearer once folded.

6. The board fuse of claim 1, wherein the insulating bearer further comprises a plurality of longitudinally extending grooves and the window is opened across the plurality of longitudinally extending grooves and divides each of the plurality of longitudinally extending grooves into two parts.

7. The board fuse of claim 1, wherein the insulating bearer includes a pair of covers hinged at one side to the insulating bearer and each provided with a locking mechanism at a side opposite the hinged side, the insulating bearer having mating locking mechanisms mounted thereto, wherein the pair of covers are locked in place to protect the plurality of fusible elements fixedly laid in the plurality of groves.

8. The board fuse of claim 1, wherein the insulating bearer is a, rectangular plate of resin.

9. The board fuse of claim 1, wherein the plurality of fusible elements are constructed of a material having a low melting point.

10. The board fuse of claim 1, wherein the continuous metal wires are each in the form of a piece of flat tape.

11. The board fuse of claim 1, wherein the continuous metal wires are each one of semi-circular and circular in cross section.

12. The board fuse of claim 1, wherein the insulating bearer has a plurality of longitudinally extending grooves in which the continuous metal wires are fixedly laid.

13. The board fuse of claim 1, wherein the plurality of longitudinally extending grooves are one of rectangular in section and circular in section.

14. A board fuse comprising:

an insulating bearer; and a plurality of fusible elements having a predetermined current capacity which are laid on a surface of the insulating bearer, wherein the insulating bearer has a through-hole window in the surface thereof and the plurality of fusible elements are laid across the recess to extend from one side of the recess to another side of the recess out of contact with the insulating bearer in an area of the recess.

15. A method of manufacturing a board fuse, the method comprising the step of:

providing a recess in a surface of an insulating bearer; and fixedly laying a plurality of fusible elements that are continuous metal wires that are substantially equal in cross section to one another and have a predetermined current capacity over the surface of the insulating board such that the plurality of fusible elements extend across the recess out of contact with the insulating board in an area of the recess.

16. The method of claim 15, wherein the step of fixedly laying the plurality of fusible elements includes providing a plurality of longitudinally extending grooves in the insulating bearer in which the plurality of fusible elements are fixedly laid and wherein the recess divides each of the plurality of longitudinally extending grooves into two parts.

17. The method of claim 1, wherein the step of fixedly laying the plurality of fusible elements includes one of applying paste to the plurality of fusible elements prior to laying the plurality of fusible elements in the plurality of longitudinally extending grooves and applying paste to the plurality of longitudinally extending grooves prior to laying the plurality of fusible elements in the plurality of longitudinally extending grooves.

18. The method of claim 17, wherein the step of fixedly laying the plurality of fusible elements includes unrolling the plurality of fusible elements from a single roll-shaped fusible-element supplier which is formed by winding flat-shaped fusible elements on a shaft in such a manner that they are in parallel with one another and then cutting the plurality of fusible elements along both ends of the insulating bearer.

19. The method of claim 17, wherein the step of fixedly laying the plurality of fusible elements includes unrolling the plurality of fusible elements from a single roll-shaped fusible-element supplier which is formed by bonding flat-shaped fusible elements on a piece of tape in such a manner that they are in parallel with one another and then winding the piece of tape together with the flat-shaped fusible elements onto a shaft, and then cutting the plurality of fusible elements along both ends of the insulating bearer.

20. The method of claim 17, wherein the step of fixedly laying the plurality of fusible elements includes unrolling the plurality of fusible elements each from a roll-shaped fusible-element supplier which is formed by winding a flat-shaped fusible element on a shaft and then cutting the plurality of fusible elements along both ends of the insulating bearer.

21. A method of manufacturing a board fuse, the method comprising the step of:

fixedly laying on a surface of an insulating bearer a plurality of fusible elements comprising continuous metal wires that are substantially equal in cross section to one another, and have a predetermined current capacity.

22. A method of manufacturing a board fuse, the method comprising the step of:

providing a recess in a surface of an insulating bearer; and fixedly laying a plurality of fusible elements having a predetermined current capacity over the surface of the insulating board such that the plurality of fusible elements extend across the recess out of contact with the insulating board in an area of the recess.

* * * * *